United States Patent [19]

Kealy et al.

[11] 4,361,238

[45] Nov. 30, 1982

[54] ORE SORTER

[75] Inventors: Wellesley A. Kealy, Beckley, England; Rolf C. Bohme, Kyalami, South Africa

[73] Assignee: General Mining Union Corporation Limited, Johannesburg, South Africa

[21] Appl. No.: 125,565

[22] Filed: Feb. 28, 1980

[30] Foreign Application Priority Data

Mar. 1, 1979 [ZA] South Africa ..... 79/0970

[51] Int. Cl.[3] ..... B07C 5/346

[52] U.S. Cl. ..... 209/576

[58] Field of Search ..... 209/539, 555, 556, 558, 209/576, 577, 589, 906, 908, 911, 644; 250/303

[56] References Cited

U.S. PATENT DOCUMENTS

| | | | |
|---|---|---|---|
| 2,717,693 | 9/1955 | Holmes | 209/576 X |
| 3,052,353 | 9/1962 | Pritchett | 209/576 X |
| 3,075,641 | 1/1963 | Hutter et al. | 209/589 X |
| 3,237,765 | 3/1966 | Gaudin et al. | 209/589 |
| 3,797,889 | 3/1974 | Wilkinson | 198/380 X |
| 3,950,643 | 4/1976 | Charlton | 250/303 |
| 4,051,952 | 10/1977 | Hauptmann et al. | 209/539 |

*Primary Examiner*—Robert J. Spar
*Assistant Examiner*—Edward M. Wacyra
*Attorney, Agent, or Firm*—Fleit & Jacobson

[57] ABSTRACT

This invention relates to apparatus for and a method of sorting ore having a radio-active component. The method includes the steps of passing a stream of ore particles through a ring detector to detect ore in the stream having a radio-active emission intensity above a predetermined level and then sorting this ore from the remainder of the ore in the stream. Preferably the invention includes the step of determining the mass of each ore particle and correlating the mass and radio-active emission measurements of the particle to determine its grade.

1 Claim, 5 Drawing Figures

FIG. 3
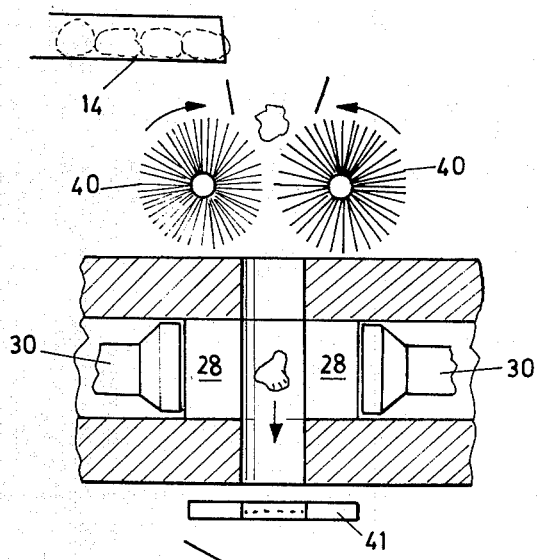
FIG. 4
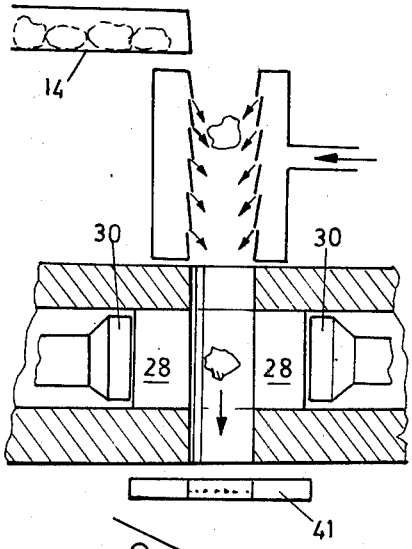
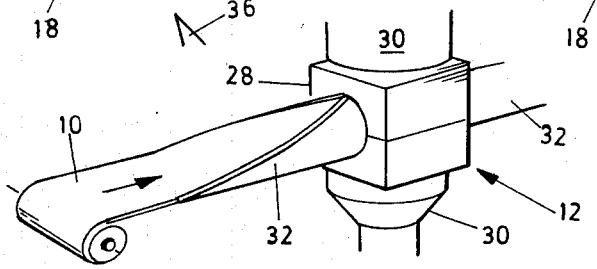
FIG. 1
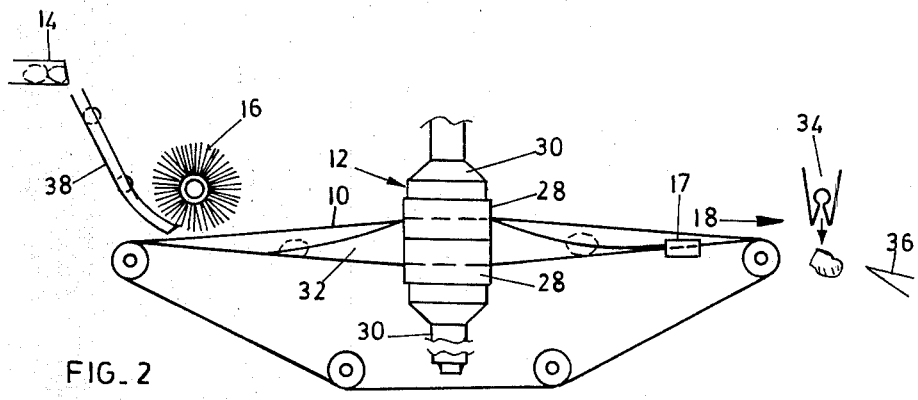
FIG. 2

ORE SORTER

FIELD OF THE INVENTION

This invention relates to a method of sorting ore having a radio-active component and to an ore sorter for sorting relatively high grade radio-active ore from lower grade ores. The word "ore" in this specification is intended to include any mined material which has a radio-active component.

BACKGROUND TO THE INVENTION

Ore sorting in dependence on the radio active properties of ore particles is known. In the majority of known systems the ore particles to be sorted are fed, for reasons of sorting economy, at a fairly high speed past a crystal scintillation detector which is positioned to one side only of the path of the particles and which measures the radioactive emission from the particles. Difficulties with known systems are that, firstly, radio active emission from the particles is more often than not substantially directional due to emission shielding by the particle material and it is possible that a high grade particle may not be detected by the crystal or only detected at an erroneously low emission level and, secondly, the emissions from the particles are sporadic and may therefore not be picked up by the crystal detector as a particle is moved at high speed past it.

Both of these difficulties seriously impair the sorting efficiency of machines employing radio-active detection.

OBJECT OF THE INVENTION

It is the object of this invention to provide a method and apparatus for minimising the difficulties mentioned above with known radio-active measurement sorting systems.

SUMMARY OF THE INVENTION

A method of sorting ore which has a radio-active component according to the invention includes the steps of, passing a stream of the ore through a ring detector to detect ore in the stream having a radio-active emission intensity above a predetermined level and sorting this ore from the remainder of the ore in the stream.

In one form of the invention the method includes the steps of, determining the mass of each particle of ore in the stream and correlating the mass of each particle with the output from the ring detector to arrive at a radio-active emission intensity to mass ratio above a predetermined level and sorting this ore from the remainder of the ore in the stream.

Preferably the stream of ore is passed through a plurality of ring detectors and the method includes the step of averaging the outputs of the detectors to arrive at an average radio-active emission intensity value for each particle in the stream.

According to the invention there is further provided an ore sorter for sorting ore having a radio-active component including a ring detector and means for sorting ore which is detected by the ring detector to have a radio-active emission intensity above a predetermined level from the remainder of the ore in the stream.

Further according to the invention the sorter includes means for determining the mass of each particle of ore in the stream and means for correlating the radio-active emission intensity of each particle with its mass to arrive at a radio-active emission intensity to mass ratio for each particle with the sorting means being driven by the correlating means to sort the particles in the stream into particles above and below a predetermined radio-active emission intensity to mass ratio.

Preferably the sorter includes, a plurality of ring detectors through which the feeding means is adapted to feed the stream of ore and means for accumulating and averaging the outputs of the ring detectors to derive an average radio-active emission intensity measurement for each particle in the stream.

In this specification the term ring detector means a device includinga passage defined by a wall which is substantially continuous in cross-section through which a particle of ore may be passed and which is capable of measuring radio-active emissions from the particle in its path through the passage. The detector may include two crystals as herein described which between them provide the particle passage or may alternatively consist of a plurality of crystals which are arranged side by side in a ring to define the passage.

BRIEF DESCRIPTION OF THE DRAWINGS

The invention is now described by way of example with reference to the drawings in which:

FIG. 1 is a diagrammatic perspective view of one embodiment of the ore sorter of the invention.

FIG. 2 is a schematic side elevation of the ore sorter of FIG. 1,

FIG. 3 is a diagrammatic side elevation of a second embodiment of the ore sorter according to the invention, FIG. 4 is a diagrammatic side elevation of a third embodiment of the ore sorter of the invention.

DETAILED DESCRIPTION OF THE INVENTION

Figure 5:
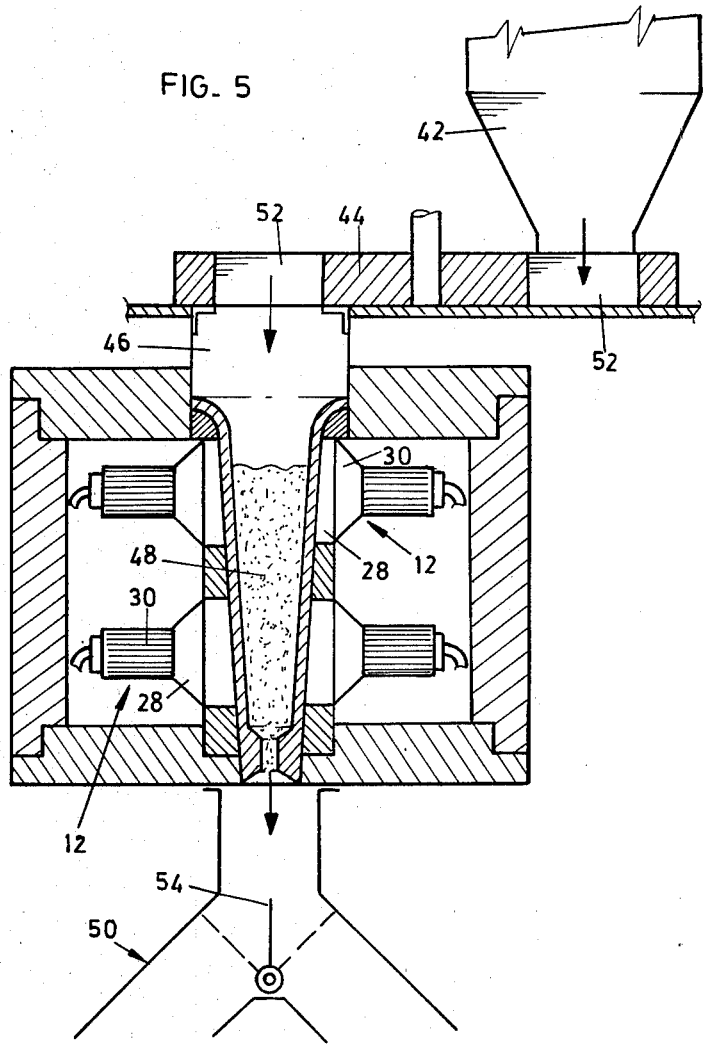
FIG. 5 is a schematic side elevation of yet a further embodiment of the sorter of the invention.

The embodiment of the invention illustrated in FIGS. 1 and 2 is shown in the drawings to consist of an endless belt conveyor 10, a crystal scintillation detector indicated generally at 12, a vibration feeder 14, a rotary brush 16, a mass meter 17 and an air jet sorter indicated generally at 18. The crystal scintillation detector 12 is located in a lead radio-activity shield not shown in the drawings.

The crystal detector 12 consists of two rectangular crystals 28 which each include a photo multiplier 30. The crystal 28 which each include a groovewhich is hemispherical in cross section and which when the crystals are located as shown in FIGS. 1 and 2 between them form a cylindrical passage through the composite crystal.

A belt guide 32, which is made from a material which will not shield radiation, passes through the passage in the composite crystal and is adapted by shape to trough the belt as it passes through the passage.

The sorter 18 consists of one or more air jets 34 and a ramp 36 which is so positioned relatively to the discharge end of the conveyor 10 that a particle of ore which is not deflected by the air jet or jets will be carried by its momentum from the belt onto the upper surface of the ramp.

In use, ore is fed from the vibration feeder 14 onto a chute 38 which delivers it to the tail end of the conveyor 12. The brush 16 is driven at the same speed as the conveyor belt and serves to decelerate the ore particles as they leave the chute 38. The particles are then fed along the conveyor and into the passage through the crystals 28. While passing along the troughed portion of the conveyor belt all of the ore particles which may previously have been spread across the width of the belt are centralised on the belt on their passage through the crystals. The crystal detector measures the radioactivity of the particles passing through the passage and stores the particular belt position of the particles having a radio-active emission intensity above a predetermined level in a memory in a computer, not shown, which is linked to both the mass meter 17 and the sorter 18.

After being measured by the detector 12 for the radio-active content the ore particles are passed over the mass meter 17 where the mass of the individual particles is determined by deflection of the conveyor belt and correlated with the radio-active measurements of the particles.

The computer includes a tracking system for tracking the position of individual ore particles on the conveyor having a radio-active intensity, mass ratio above a predetermined level right up to the point when a particular particle of ore leaves the conveyor and reaches the discriminatory point of the sorter 18. When the particle reaches the discriminatory point of the sorter a signal from the computer will, in dependence on whether the radio-active intensity, mass ratio of the particle is above or below the predetermined level, either activate the air jet 34 to deflect the particle below the ramp 36 onto a conveyor, not shown, or de-activate the jet to allow the particle to be projected under its own momentum from the belt onto the ramp 36 and from there onto a conveyor not shown.

In the embodiments of the sorter illustrated in FIGS. 3 and 4 like reference numbers denote like components to those of the FIGS. 1 and 2 embodiment. In the FIGS. 3 and 4 embodiments of the sorter of the invention the crystal scintillation detectors are so arranged that the passage through the composite crystal is vertically orientated. The sorter 18 which operates in the same manner as the embodiment illustrated in FIGS. 1 and 2 is located below the passage through the crystal. In both the FIGS. 3 and 4 embodiments ore particles are discharged from the vibrator feeder 14 into a vertical chute through which the particles of ore are guided into the passage through the detector crystals.

The sorter illustrated in FIG. 3 includes at least two rotary brushes 40 arranged in the particle guide chute as illustrated in the drawing. In use, particles of ore are dropped from the vibration feeder 14 into the chute and axially aligned with the passage through the crystals by the rotating brushes 40.

In the FIG. 4 embodiment of the invention the chute consists of an annular chamber into which air under pressure is fed to leave the chamber as jets adapted to centralise all particles falling through the chute.

The mass determination of the particles in the FIGS. 3 and 4 embodiments of the sorter is accomplished by a known light gate arrangement 41 which is located across the particle path as it leaves the passage through the crystal. The gate 41 is adapted to measure the length of the particles and to determine their shape in two dimensions during their passage through the gate. From this information the mass of each particle is calculated and correlated with its radio-active measurement as with the embodiment of FIGS. 1 and 2 to determine the category into which it is to be sorted by the sorter 18.

Although the embodiments of the sorter illustrated have only one detector 12 the sorters could, and preferably do, include two or more detectors which are located serially around the particle stream path. These detectors are electrically adapted to accumulate the radio-active emissions from each particle with the accumulated emissions finally being averaged to arrive at an average radio-active value for each particle which is then correlated with its mass measurement. By this means together with the fact that the detectors measure the radiation emitted from each particle in all directions, far more accurate radioactive measurements may be made of each high speed particle with the method and apparatus of the invention than with known methods and machines. Additionally the invention provides an accurate method of measuring the radio-active emission of particles which have a lower emissive level than could practically have been usefully measured and sorted on prior art sorters.

The embodiment of the sorter illustrated in FIG. 5 is intended for the blk sorting of granular material and includes a hopper 42, a rotary batch feeder 44, a second hopper 46 into which the batch feeder discharges and which itself discharges through an elongated throat 48 which has a choked outlet and is surrounded by two spaced crystal scintillation ring-detectors 12 and a mechanical sorter indicated generally at 50.

The batch feeder 44 includes a disc shaped rotor which carries a number of spaced circular openings or pockets 52. The rotor is rotatable about its axis in a housing which includes an inlet below the hopper 42 and an outlet into the hopper 46.

In use, the pockets 52 of the feeder 44 are filled from the hopper 42 and sequentially discharged into the hopper 46 which fills to a predetermined level which is determined by parameters such as the dimensions of the pockets 52, hopper 46, throat 48 and the choke at the outlet of the throat 48 so that ore will gravitate through the throat at an approximately constant rate. As the particulate material including ore gravitates through the throat 48 and past the detectors 12 the radiation from each transverse band of ore in the throat 48 is measured sequentially by each of the detectors 12 and the measurements stored in a computer memory. The two radio-active measurements relating to each particular band of ore are integrated as described above to arrive at an average level of radio-activity for both measurements of each band of ore which is then computed with tracking information to derive a switching signal for the sorter 50.

The sorter 50 includes an inlet chute which divides into two outlet chutes and a gate 54 for closing either of the outlet chutes.

When a batch of ore having an average radio-active intensity above a predetermined level leaves the choke of the throat 48 and reaches the discriminatory point of the sorter the gate is operated to switch so that ore above the predetermined radio-active intensity level is discharged from one outlet while ore below the predetermined radioactive intensity level is discharged from the other.

The sorter 50 could include three discharge chutes and two synchronised gates so that three grades of ore may be sorted by the sorter.

The invention is not limited to the precise constructional details as herein described. For example, the mass meter 17 in the FIGS. 1 and 2 embodiments could be replaced by a light gate, such as the gate 41 described with reference to the FIGS. 3 and 4 embodiments. In this case the gate would conveniently be located in space in the path of the ore particles as they leave the conveyor 10. Additionally, the light gate 41 in the FIGS. 3 and 4 embodiments could be located above the particle passage through the crystals and in addition to determining the mass of the particles as they enter the passage the gate could be employed to limit the count time of the radiation detectors to only the time in which each particle is within the immediate scan zone of the or each detector to minimise the effect that the radiation of preceding and following particles would have on each particle while in the immediate scan zone of a particular detector.

We claim:

1. Apparatus for the bulk sorting of particulate ore which comprises:

means defining a passage through which a stream of the ore is continuously moved under the action of gravity;

means for feeding individual batches of particulate ore into said passage defining means, said passage defining means having a downwardly converging shape and being sized to hold a plurality of batches;

detector means adjacent the passage for providing a measure of the radioactive emission intensity of successive transverse bands of the ore in the passage; and means for sorting the bands of ore on the basis of such measure.

* * * * *